US011884998B2

(12) United States Patent
Sengoku et al.

(10) Patent No.: US 11,884,998 B2
(45) Date of Patent: Jan. 30, 2024

(54) SURFACE TREATED STEEL SHEET

(71) Applicant: NIPPON STEEL CORPORATION, Tokyo (JP)

(72) Inventors: Akihiro Sengoku, Tokyo (JP); Hiroshi Takebayashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 396 days.

(21) Appl. No.: 16/499,830

(22) PCT Filed: Mar. 31, 2017

(86) PCT No.: PCT/JP2017/013762

§ 371 (c)(1),
(2) Date: Sep. 30, 2019

(87) PCT Pub. No.: WO2018/179397

PCT Pub. Date: Oct. 4, 2018

(65) Prior Publication Data

US 2020/0024708 A1 Jan. 23, 2020

(51) Int. Cl.
*C22C 38/04* (2006.01)
*B21D 22/00* (2006.01)
(Continued)

(52) U.S. Cl.
CPC ..... *C22C 38/04* (2013.01); *B21D 22/00* (2013.01); *C22C 38/02* (2013.01); *C23C 2/06* (2013.01); *C23C 2/12* (2013.01); *C23C 4/08* (2013.01)

(58) Field of Classification Search
CPC ..... B21D 22/00–125; C23C 2/06; C23C 2/12; C23C 4/067; C23C 4/08; C23C 2/261;
(Continued)

(56) References Cited

U.S. PATENT DOCUMENTS 6,610,422 B1 8/2003 Ooi et al.
9,428,824 B2 8/2016 Liu
(Continued)

FOREIGN PATENT DOCUMENTS

CN 102312130 A 1/2012
CN 104955975 A 9/2015
(Continued)

OTHER PUBLICATIONS

Cheng et al, "Study of microstructure and phase evolution of hot-dipped aluminide mild steel during high-temperature diffusion using electron backscatter diffraction", 2011. Applied Surface Science, vol. 257, pp. 4663-4668. (Year: 2011).*
(Continued)

*Primary Examiner* — John A Hevey
(74) *Attorney, Agent, or Firm* — Birch, Stewart, Kolasch & Birch, LLP

(57) ABSTRACT

Provided is a surface treated steel sheet which includes a base metal, and a plated layer formed on a surface of the base metal, wherein an average composition of the plated layer contains, in mass %, Mg: 0.5 to 2.0%, and [60.0≤Zn+Al≤98.0], [0.4≤Zn/Al≤1.5], and [Zn/Al×Mg≤1.6] are satisfied.

4 Claims, 1 Drawing Sheet

(51) Int. Cl.

| | |
|---|---|
| ***C22C 38/02*** | (2006.01) |
| ***C23C 2/06*** | (2006.01) |
| ***C23C 2/12*** | (2006.01) |
| ***C23C 4/08*** | (2016.01) |

(58) Field of Classification Search
CPC .... C23C 2/28; C23C 2/29; C23C 2/40; C23C 30/00; C22C 38/04; C22C 38/02
See application file for complete search history.

(56) References Cited

U.S. PATENT DOCUMENTS

| | | | | |
|---|---|---|---|---|
| 2013/0236739 | A1 | 9/2013 | Yoshida et al. | |
| 2014/0120369 | A1 | 5/2014 | Warichet et al. | |
| 2015/0337428 | A1 | 11/2015 | Ooi et al. | |
| 2016/0222484 | A1* | 8/2016 | Koyer | B32B 15/013 |
| 2016/0318093 | A1* | 11/2016 | Maki | C23C 22/07 |
| 2019/0160507 | A1 | 5/2019 | Sengoku et al. | |
| 2020/0002803 | A1* | 1/2020 | Kwak | C23C 2/06 |

FOREIGN PATENT DOCUMENTS

| | | | | |
|---|---|---|---|---|
| CN | 106282873 | A | 1/2017 | |
| JP | 2003-49256 | A | 2/2003 | |
| JP | 2003-73774 | A | 3/2003 | |
| JP | 2005-113233 | A | 4/2005 | |
| JP | 2008-69398 | A | 3/2008 | |
| JP | 2012-112010 | A | 6/2012 | |
| JP | 2012-237048 | A | 12/2012 | |
| JP | 2014-88616 | A | 5/2014 | |
| JP | 2015-214749 | A | 12/2015 | |
| JP | 2016-153539 | A | 8/2016 | |
| JP | 2016-166415 | A | 9/2016 | |
| JP | 2016-539249 | A | 12/2016 | |
| RU | 2553128 | C2 | 6/2015 | |
| TW | 575643 | B | 2/2004 | |
| WO | WO 2014/059474 | A1 | 4/2014 | |
| WO | WO-2015098653 | A1 * | 7/2015 | B21D 22/208 |
| WO | WO2017/017514 | A1 | 2/2017 | |
| WO | WO 2017/195269 | A1 | 11/2017 | |
| WO | WO-2018096387 | A1 * | 5/2018 | B21D 22/022 |

OTHER PUBLICATIONS

Machine translation of CN-102312130-A, published on Jan. 11, 2012.
Machine translation of JP-2008-69398-A, published on Mar. 27, 2008.
Machine translation of JP-2012-112010-A, published on Jun. 14, 2012.
Machine translation of JP-2015-214749-A, published on Dec. 3, 2015.
Machine translation of JP-2016-153539-A, published on Aug. 25, 2016.
Machine translation of JP-2016-166415-A, published on Sep. 15, 2016.
Russian Decision on Grant and Search Report, dated Feb. 27, 2020, for Russian Application No. 2019134830, with English translations.
International Preliminary Report on Patentability dated Oct. 10, 2019 and Written Opinion of the International Searching Authority (Forms PCT/IB/326, PCT/IB/373, PCT/ISA/237) for International Application No. PCT/JP2017/013760, dated May 30, 2017, with English translation.
International Preliminary Report on Patentability, dated Oct. 10, 2019 and Written Opinion of the International Searching Authority (Forms PCT/IB/326, PCT/IB/373 and PCT/ISA/237) for International Application No. PCT/JP2017/013760, dated Jun. 20, 2017, with English translation.
International Search Report (Form PCT/ISA/210) for International Application No. PCT/JP2017/013760, dated May 30, 2017, with English translation.
International Search Report (Form PCT/ISA/210) for International Application No. PCT/JP2017/013762, dated Jun. 20, 2017, with English translation.
Nissin Steel Co., Ltd., "Kenzaiyo Hyomen Shori Kohan no Kaihatsu Doko," The Iron Steel Institute of Japan, Oct. 2015, pp. 67-68 with English translation (5 pages total).
Taiwanese Office Action and Search Report for Taiwanese Application No. 106111209, dated Aug. 27, 2018.
Taiwanese Office Action and Search Report for Taiwanese Application No. 106111210, dated Dec. 26, 2017.
Taiwanese Office Action for Taiwanese Application No. 106111209, dated Apr. 19, 2019.
U.S. Appl. No. 16/499,795, filed Sep. 30, 2019.

* cited by examiner

PRESENT INVENTION
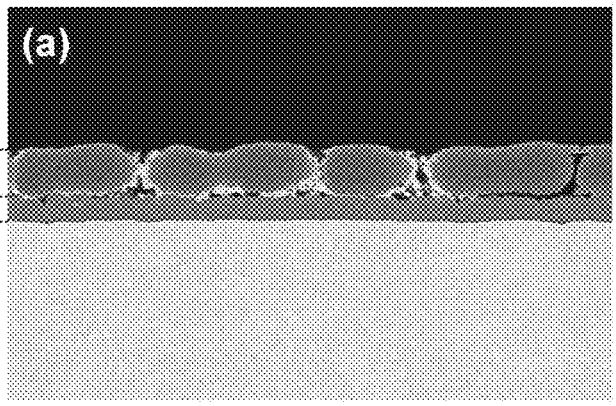
CONVENTIONAL ART
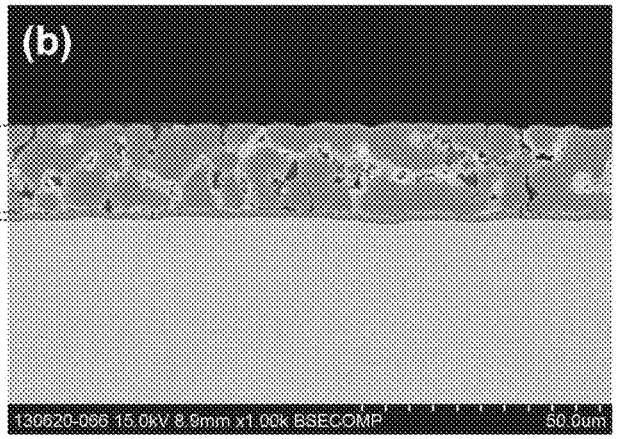

SURFACE TREATED STEEL SHEET

TECHNICAL FIELD

The present invention relates to a surface treated steel sheet.

BACKGROUND ART

Structural members (formed bodies) used for automobiles or the like may be produced by performing hot stamping (hot pressing) so as to increase both strength and dimensional accuracy. In producing a formed body by performing hot stamping, a steel sheet is heated to the $Ac_3$ point or above, and is rapidly cooled while being subjected to pressing by press tooling. That is, in this production process, pressing and quenching are performed simultaneously. By performing hot stamping, it is possible to produce a formed body having high dimensional accuracy and high strength.

However, a formed body produced by performing hot stamping has been subjected to a high temperature and hence, scale is formed on the surface. Accordingly, a technique is proposed in which a plated steel sheet (surface treated steel sheet) is used as a hot stamping steel sheet so that formation of scale is suppressed and, further, corrosion resistance is enhanced (see Patent Documents 1 to 3).

For example, Patent Document 1 discloses a steel sheet for hot pressing having a Zn plated layer. Patent Document 2 discloses an aluminum plated steel sheet for high strength automobile component having an Al plated layer. Further, Patent Document 3 discloses a Zn-based plated steel material for hot pressing where various elements, such as Mn, are added into the plated layer of a Zn plated steel sheet.

LIST OF PRIOR ART DOCUMENTS

Patent Document

Patent Document 1: JP2003-73774A
Patent Document 2: JP2003-49256A
Patent Document 3: JP2005-113233A

SUMMARY OF INVENTION

Technical Problem

In the technique disclosed in Patent Document 1, Zn remains in an outer layer of a steel material after hot stamping is performed and hence, high sacrificial anticorrosive action can be expected. However, a steel sheet is worked in a state where Zn is dissolved and hence, there is a possibility that molten Zn enters the steel sheet so that cracks occur in the steel material. This crack is referred to as Liquid Metal Embrittlement (hereinafter also referred to as "LME"). Fatigue properties of the formed body deteriorate due to LME.

At present, to avoid occurrence of LME, it is necessary to suitably control heating conditions for performing working on a steel sheet. To be more specific, a method or the like is adopted where heating is performed until all molten Zn is diffused in a steel sheet to form Fe—Zn solid solution. However, these methods require long time heating and, as a result, there is a problem that productivity declines.

In the technique disclosed in Patent Document 2, Al having a higher fusing point than Zn is used for a plated layer and hence, different from Patent Document 1, molten metal is less likely to enter a steel sheet. Accordingly, it is predicted that excellent LME resistance can be obtained and, eventually, the formed body subjected to hot stamping is excellent in fatigue property. However, a steel material on which an Al plated layer is formed has a problem that it is difficult to form a phosphate film at the time of performing phosphate treatment, which is performed before coating is applied to automobile components. In other words, some steel materials may not obtain sufficient phosphatability, thus degrading corrosion resistance after coating.

Further, in the technique disclosed in Patent Document 3, spot weldability is enhanced by modifying an outermost layer (oxide film) after hot stamping is performed. However, depending on an element to be added, LME still occurs so that there is a possibility that a hot stamp steel material cannot obtain sufficient fatigue property. Further, depending on an element to be added, there is also a possibility that phosphatability of the steel material is also degraded in addition to fatigue property.

An objective of the present invention, which has been made to overcome the above-mentioned problems, is to provide a surface treated steel sheet which is preferably used as a starting material of a formed body excellent in fatigue property, spot weldability, and corrosion resistance after coating.

Solution to Problem

The present invention has been made to overcome the above-mentioned problems, and the gist of the present invention is the following surface treated steel sheet.

(1) A surface treated steel sheet including: a base metal and a plated layer formed on a surface of the base metal, wherein an average composition of the plated layer contains, in mass %, Mg: 0.5 to 2.0%, and following formulas (i) to (iii) are satisfied:

$$75.0 \leq Zn+Al \leq 98.5 \quad \text{(i)}$$

$$0.4 \leq Zn/Al \leq 1.5 \quad \text{(ii)}$$

$$Zn/Al \times Mg \leq 1.6 \quad \text{(iii)}$$

where, symbol of an element in the formulas refers to content (mass %) of each element contained in the plated layer.

(2) The surface treated steel sheet described in the above-mentioned (1), wherein the average composition of the plated layer further contains, in mass %, Si: more than 0% and 15.0% or less.

(3) The surface treated steel sheet described in the above-mentioned (1) or (2), wherein the average composition of the plated layer further satisfies a following formula (iv):

$$Mg+Ca+Ti+Sr+Cr \leq 2.0 \quad \text{(iv)}$$

where, symbol of an element in the formula refers to content (mass %) of each element contained in the plated layer.

(4) The surface treated steel sheet described in any one of the above-mentioned (1) to (3), wherein the plated layer includes an Fe diffusion layer on a base metal side of the plated layer, and a ratio of a thickness of the Fe diffusion layer to an entire thickness of the plated layer is between 15 and 50%.

(5) The surface treated steel sheet described in the above-mentioned (4), wherein the average composition of the plated layer further contains, in mass %, Fe: 5.0 to 25.0%.

(6) The surface treated steel sheet described in any one of the above-mentioned (1) to (5), wherein a chemical composition of the base metal contains, in mass %, C: 0.05 to 0.4%, Si: 0.5% or less, and Mn: 0.5 to 2.5%.

(7) The surface treated steel sheet described in any one of the above-mentioned (1) to (6), wherein the surface treated steel sheet is for hot stamping.

Advantageous Effects of Invention

A surface treated steel sheet according to the present invention can be subjected to hot stamping to obtain a formed body excellent in fatigue property, spot weldability, and corrosion resistance after coating.

BRIEF DESCRIPTION OF DRAWINGS

FIG. 1 is one example of an image of a cross section of the surface treated steel sheet according to one embodiment of the present invention obtained by performing SEM observation.

DESCRIPTION OF EMBODIMENTS

Inventors of the present invention have conducted studies on the configuration of a surface treated steel sheet which is preferably used as a starting material of a formed body excellent in LME resistance at the time of performing hot stamping forming, and also excellent in spot weldability and corrosion resistance after coating after hot stamping is performed.

First, the inventors of the present invention have conducted studies on a method for enhancing corrosion resistance after coating of a formed body. As a result, the inventors of the present invention have found that corrosion resistance of a formed body subjected to hot stamping can be enhanced by causing a plated layer of the surface treated steel sheet to contain Mg. However, it is found that when hot stamping forming is performed on a surface treated steel sheet whose plated layer contains Mg, LME easily occurs, thus deteriorating fatigue property. Further, when Mg content in the plated layer is excessively high, spot weldability of a formed body produced using a plated layer including such a plated layer is also decreased.

Accordingly, the inventors of the present invention have conducted extensive studies on a method for enhancing corrosion resistance without deteriorating LME resistance and spot weldability. As a result, the following result is obtained. All of the above-mentioned properties can be ensured with a good balance by appropriately controlling Mg content in the plated layer of the surface treated steel sheet.

The present invention is made based on the above-mentioned findings. Hereinafter, the respective requirements of the present invention are described in detail.

(A) Overall Configuration

The surface treated steel sheet according to one embodiment of the present invention includes a base metal and a plated layer formed on the surface of the base metal. Each component is described in detail hereinafter.

(B) Base Metal

Improvement of fatigue property, spot weldability, and corrosion resistance after coating after stamping forming is performed, which is the task for this embodiment, can be achieved by the configuration of the plated layer of the surface treated steel sheet. Accordingly, the base metal of the surface treated steel sheet according to this embodiment is not particularly limited. However, when the components of the base metal fall within ranges described hereinafter, it is possible to obtain the formed body having favorable mechanical properties in addition to fatigue property, spot weldability, and corrosion resistance after coating.

The reasons for limiting respective elements are as follows. In the description made hereinafter, symbol "%" for content refers to "mass %".

C: 0.05 to 0.4%

C (carbon) is an element which increases strength of a formed body on which hot stamping is performed. When a content of C is excessively low, the above-mentioned effect cannot be obtained. On the other hand, when the C content is excessively high, toughness of a steel sheet decreases. Accordingly, the C content is set to 0.05 to 0.4%. The C content is preferably 0.10% or more, and is more preferably 0.13% or more. Further, the C content is preferably 0.35% or less.

Si: 0.5% or Less

Si (silicon) is an element which is inevitably contained, and has an action of deoxidizing steel. However, when a content of Si is excessively high, Si in steel is diffused during heating of a hot stamp and hence, oxide is formed on the surface of a steel sheet, thus degrading phosphatability. Si is also an element which raises the $Ac_3$ point of a steel sheet. When the $Ac_3$ point is raised, there is a possibility that a heating temperature at the time of performing hot stamping exceeds the evaporation temperature of Zn plating. Accordingly, the Si content is set to 0.5% or less. The Si content is preferably 0.3% or less, and is more preferably 0.2% or less. There is no limitation on the lower limit value of the Si content in terms of the above-mentioned properties of a product. However, as described above, Si is used for deoxidation and hence, there is a substantial lower limit value. Although the lower limit value of the Si content varies according to the required level of deoxidation, the lower limit value of the Si content is usually 0.05%.

Mn: 0.5 to 2.5%

Mn (Manganese) is an element which increases hardenability, thus increasing strength of a formed body on which hot stamping is performed. When a content of Mn is excessively low, this effect cannot be obtained. On the other hand, when the Mn content is excessively high, this effect is saturated. Accordingly, the Mn content is set to a value within a range from 0.5 to 2.5%. The Mn content is preferably 0.6% or more, and is more preferably 0.7% or more. Further, the Mn content is preferably 2.4% or less, and is more preferably 2.3% or less.

P: 0.03% or Less

P (phosphorus) is an impurity contained in steel. P segregates at crystal grain boundaries, thus decreasing toughness of the steel hence leading to degrading of delayed fracture resistance. Accordingly, a content of P is set to 0.03% or less. It is preferable to reduce the P content as much as possible.

S: 0.01% or Less

S (sulfur) is an impurity contained in steel. S forms sulfides, thus decreasing toughness of the steel hence leading to degrading of delayed fracture resistance. Accordingly, a content of S is set to 0.01% or less. It is preferable to reduce the S content as much as possible.

sol. Al: 0.1% or Less

Al (Aluminum) is an element which is generally used for deoxidizing steel, and is inevitably contained. However, when a content of Al is excessively high, although deoxidation is sufficiently performed, there is a possibility that the $Ac_3$ point of a steel sheet is raised so that a heating temperature at the time of performing hot stamping exceeds an evaporation temperature of Zn plating. Accordingly, the Al content is set to 0.1% or less. The Al content is preferably 0.05% or less. To obtain the above-mentioned advantageous effects, the Al content is preferably 0.01% or more. In this specification, the Al content means content of sol. Al (acid-soluble Al).

N: 0.01% or Less

N (nitrogen) is an impurity which is inevitably contained in steel. N forms nitrides, thus decreasing toughness of the steel. Further, in the case where B is contained in steel, N is bonded to B, thus reducing the amount of dissolved B and, eventually, decreasing hardenability. Accordingly, a content of N is set to 0.01% or less. It is preferable to reduce the N content as much as possible.

B: 0 to 0.005%

B (boron) has an effect of increasing hardenability of the steel, thus increasing strength of a formed body on which hot stamping is performed. Accordingly, B may be contained when necessary. However, when a content of B is excessively high, this effect is saturated. Accordingly, the B content is set to 0.005% or less. To obtain the above-mentioned advantageous effects, the T B content is preferably 0.0001% or more.

Ti: 0 to 0.1%

Ti (titanium) is bonded to N, thus forming nitrides. When Ti and N are bonded to each other in this manner, bonding between B and N is suppressed and hence, it is possible to suppress degrading of hardenability caused by the formation of BN. Accordingly, Ti may be contained when necessary. However, when a content of Ti is excessively high, the above-mentioned effect is saturated and, further, an excessively large amount of Ti nitride precipitates, thus decreasing toughness of the steel. Accordingly, the Ti content is set to 0.1% or less. Ti makes a fine austenite grain size at the time of heating by a hot stamp by pinning effect of Ti, thus increasing toughness and the like of the formed body. To obtain the above-mentioned advantageous effects, the Ti content is preferably 0.01% or more.

Cr: 0 to 0.5%

Cr (chromium) has an effect of increasing hardenability of the steel. Accordingly, Cr may be contained when necessary. However, when a content of Cr is excessively high, Cr carbide is formed. This Cr carbide is not easily dissolved at the time of heating the hot stamp and hence, austenitization is prevented from easily progressing, thus degrading hardenability. Accordingly, the Cr content is set to 0.5% or less. To obtain the above-mentioned advantageous effects, the Cr content is preferably 0.1% or more.

Mo: 0 to 0.5%

Mo (molybdenum) has an effect of increasing hardenability of the steel. Accordingly, Mo may be contained when necessary. However, when a content of Mo is excessively high, the above-mentioned effect is saturated. Accordingly, the Mo content is set to 0.5% or less. To obtain the above-mentioned advantageous effects, the Mo content is preferably 0.05% or more.

Nb: 0 to 0.1%

Nb (niobium) forms carbides, thus having an effect of refining grains at the time of performing hot stamping hence leading to an increase in toughness of the steel. Accordingly, Nb may be contained when necessary. However, when a content of Nb is excessively high, not only that the above-mentioned effect is saturated, but also that hardenability is degraded. Accordingly, the Nb content is set to 0.1% or less. To obtain the above-mentioned advantageous effects, the Nb content is preferably 0.02% or more.

Ni: 0 to 1.0%

Ni (nickel) has an effect of increasing toughness of the steel. Further, Ni suppresses embrittlement attributable to the presence of molten Zn at the time of heating by the hot stamp. Accordingly, Ni may be contained when necessary. However, when a content of Ni is excessively high, these effects are saturated. Accordingly, the Ni content is set to 1.0% or less. To obtain the above-mentioned advantageous effects, the Ni content is preferably 0.1% or more.

In the chemical composition of the base metal which forms the surface treated steel sheet of this embodiment, the balance consists of Fe and impurities. In this embodiment, "impurity" means a component which, in industrially producing steel sheets, may be mixed in ores or scrap forming raw materials, or a component which may be mixed due to a production environment or the like, the component not being intentionally added.

(C) Plated Layer

The plated layer according to the present invention contains Zn and Al as a main component. That is, the average composition of the plated layer satisfies the following formula (i). Causing the plated layer of the surface treated steel sheet to satisfy the following condition can enhance fatigue property, spot weldability, and corrosion resistance after coating of the formed body subjected to hot stamping.

$$75.0 \leq Zn+Al \leq 98.5 \quad \text{(i)}$$

where, symbol of an element in the formula refers to content (mass %) of each element contained in the plated layer.

An importance is also placed on a ratio of Zn to Al. Accordingly, the average composition of the plated layer of the present invention satisfies the following formula (ii). When the value of Zn/Al becomes less than 0.4, phosphatability cannot be ensured so that corrosion resistance after coating is deteriorated. On the other hand, when the value of Zn/Al exceeds 1.5, LME cannot be suppressed so that fatigue property is deteriorated. Accordingly, the value of Zn/Al is preferably 1.2 or less, is more preferably 1.0 or less, and is further preferably 0.8 or less.

$$0.4 \leq Zn/Al \leq 1.5 \quad \text{(ii)}$$

In the present invention, the average composition of the plated layer further contains, in mass %, Mg: 0.5 to 2.0%. When a content of Mg in the plated layer is less than 0.5%, an effect of enhancing corrosion resistance of the formed body subjected to hot stamping is insufficient. On the other hand, the Mg content exceeding 2.0% increases a risk of LME occurring at the time of performing hot stamping. Further, Mg is easily oxidized, thus being concentrated, as oxide, on the outer layer of the formed body subjected to hot stamping. Oxide of Mg has high electrical resistance and hence, when Mg oxide is excessively concentrated, weldability of the formed body is decreased. The Mg content in the plated layer is preferably 0.6% or more, and is more preferably 0.8% or more. Further, the Mg content is preferably 1.8% or less, and is more preferably 1.5% or less.

It is also necessary to adjust the Mg content in the plated layer in relation with the Zn content and the Al content. To be more specific, the following formula (iii) is required to be satisfied. When the value of Zn/Al×Mg exceeds 1.6, LME cannot be suppressed so that fatigue property is deteriorated. The value of Zn/Al×Mg is preferably 1.4 or less, is more preferably 1.2 or less, and is further preferably 1.0 or less.

$$Zn/Al \times Mg \leq 1.6 \quad \text{(iii)}$$

The average composition of the plated layer may further contain, in mass %, Si: more than 0% and 15.0% or less. Causing the plated layer to contain Si can enhance adhesiveness between the base metal and the plated layer. However, when a content of Si in the plated layer exceeds 15.0%, there is a possibility that property, such as corrosion resistance or weldability, of the formed body subjected to hot stamping cannot be ensured. Accordingly, the Si content is preferably 0.1% or more, and is more preferably 0.3% or more.

When the Si content in the plated layer increases, the formation of an Fe diffusion layer described later is suppressed. Accordingly, when it is desired to promote the formation of the Fe diffusion layer, the Si content is preferably 10.0% or less, and is more preferably 5.0% or less.

The plated layer may further contain Cr, Ca, Sr, Ti or the like. However, these elements are easily oxidized in the same manner as Mg. Accordingly these elements are concentrated, as oxide, on the outer layer of the formed body subjected to hot stamping. Oxides of these elements also have high electrical resistance and hence, when these elements are excessively concentrated, weldability of the formed body is decreased. Accordingly, in the case where the plated layer contains these elements, it is preferable that the average composition of the plated layer satisfy the following formula (iv) in relation with the Mg content.

$$Mg+Ca+Ti+Sr+Cr \leq 2.0 \quad \text{(iv)}$$

In the present invention, it is assumed that the average composition of the plated layer is obtained by the following method. First, a surface treated steel sheet which includes the plated layer is dissolved with 10% HCl aqueous solution. At this point of operation, to cause only the plated layer to be dissolved, inhibitor which suppresses dissolution of Fe in the base metal is added to hydrochloric acid. Then, respective elements contained in the dissolved solution are measured by inductively coupled plasma emission spectrometry (ICP-OES).

It is preferable that the plated layer according to the present invention include the Fe diffusion layer on the base metal side of the plated layer. The Fe diffusion layer has a micro-structure which contains an Fe—Al—Zn phase as a main component. The description "contains an Fe—Al—Zn phase as a main component" means that the total area fraction of the Fe—Al—Zn phase is 90% or more. The total area fraction of the Fe—Al—Zn phase is preferably 95% or more, and is more preferably 99% or more. The Fe—Al—Zn phase of the present invention is a collective term for $Fe(Al, Zn)_2$, $Fe_2(Al, Zn)_5$ or $Fe(Al, Zn)_3$. Particularly, a content of Fe in the Fe diffusion layer is set to a value which falls within a range from 20 to 55 mass %. The above-mentioned Fe—Al—Zn phase may contain Si.

In the case where the surface treated steel sheet is subjected to cold rolling, the presence of the Fe diffusion layer may form the starting point of crack. Accordingly, usually, it is preferable to prevent the formation of the Fe diffusion layer as much as possible. On the other hand, in the case where the surface treated steel sheet is subjected to hot stamping, when the plated layer includes the Fe diffusion layer which contains an Fe—Al—Zn phase as a main component, alloying process of Zn and Al in the plated layer is promoted at the time of performing hot stamping and hence, an Fe—Al alloy is rapidly formed. The formation of the Fe—Al alloy is promoted particularly in the vicinity of an interface with the base metal, thus exhibiting an effect of suppressing LME. In the present invention, an Fe—Al alloy is a collective term for αFe, $Fe_3Al$, and FeAl.

When it is desired to obtain the above-mentioned advantageous effect, it is preferable to set the ratio of the thickness of the Fe diffusion layer to the entire thickness of the plated layer of the present invention to 15 to 50%. When the above-mentioned ratio is less than 15%, an effect of suppressing LME cannot be sufficiently obtained. On the other hand, when the above-mentioned ratio exceeds 50%, cracks may be formed at the time of winding up the steel sheet into a coil shape. Accordingly, the ratio of the thickness of the Fe diffusion layer to the entire thickness of the plated layer is preferably 20% or more, and is more preferably 25% or more. Further, the ratio of the thickness of the Fe diffusion layer is preferably 45% or less, and is more preferably 40% or less.

FIG. 1 shows one example of an image of the cross section of the surface treated steel sheet according to one embodiment of the present invention obtained by performing SEM observation. FIG. 1(*a*) shows an example where plating treatment is performed under conditions for positively forming the Fe diffusion layer. On the other hand, FIG. 1(*b*) shows an example where plating treatment is performed under normal conditions. It can be seen from FIG. 1 that borders between the Fe diffusion layer in the plated layer and other layers can be clearly observed.

Also from the results of EPMA analysis of the plated layer, it can be confirmed that the Fe content in the Fe diffusion layer is 20% or more so that the Fe diffusion layer has a micro-structure which contains, as a main component, an Fe—Al—Zn phase with the Fe content falling within a range from 20 to 55 mass %. The Fe content in the layer other than the Fe diffusion layer is less than 20%. Accordingly, in the present invention, the entire thickness of the plated layer and the thickness of the Fe diffusion layer are measured from the results of the EPMA analysis and the SEM observation. Further, in the present invention, after the cross section of plating is subjected to SEM observation, the entire thickness of the plated layer and the thickness of the Fe diffusion layer are measured at arbitrary twelve points. The average value of measurement values at ten portions excluding the maximum and minimum values is adopted as the entire thickness of the plated layer or the thickness of the Fe diffusion layer.

The limitation is not particularly imposed on the entire thickness of the plated layer of the present invention. For example, the entire thickness of the plated layer may be set to 5 to 40 μm. The entire thickness of the plated layer is preferably 10 μm or more, and is more preferably 30 μm or less. The limitation is also not particularly imposed on the thickness of the Fe diffusion layer. However, when it is desired to obtain an effect of suppressing LME, the thickness of the Fe diffusion layer is preferably set to 3 μm or more. On the other hand, when the thickness of the Fe diffusion layer is excessively large, cracks may be formed at the time of winding up the steel sheet into a coil shape. Accordingly, the thickness of the Fe diffusion layer is preferably set to 10 μm or less.

Further, in the case where the Fe diffusion layer is sufficiently formed so as to obtain an effect of suppressing LME, it is preferable that the average composition of the plated layer further contains, in mass %, Fe: 5.0 to 25.0%.

(D) Production Method

A step of producing the surface treated steel sheet of this embodiment includes a step of producing a base metal, and a step of forming a plated layer on the surface of the base metal. Hereinafter, each step is described in detail.

[Base Metal Producing Step]

In the base metal producing step, a base metal of a surface treated steel sheet is produced. For example, molten steel which has the above-mentioned chemical composition is produced. Then, using this molten steel, a slab is produced by a casting process, or an ingot is produced by an ingot-making process. Next, the slab or the ingot is subjected to hot rolling, thus obtaining a base metal (hot-rolled sheet) of the surface treated steel sheet. It may be possible to adopt the configuration where pickling treatment is performed on the above-mentioned hot-rolled sheet, and cold rolling is performed on the hot-rolled sheet on which the pickling treatment is performed, thus obtaining a cold rolled sheet, and this cold rolled sheet is used as the base metal of the surface treated steel sheet.

[Plating Treatment Step]

In the plating treatment step, an Al—Zn—Mg plated layer is formed on the surface of the above-mentioned base metal, thus producing a surface treated steel sheet. As a method for forming the Al—Zn—Mg plated layer, hot dip plating treatment may be adopted. Alternatively, any other treatment may be adopted such as spraying plating treatment or vapor deposition plating treatment. To increase adhesiveness between the base metal and the plated layer, it is preferable to cause the plated layer to contain Si.

For example, an example of forming the Al—Zn—Mg plated layer by hot dip plating treatment is as follows. That is, the base metal is immersed into a hot dipping bath consisting of Al, Zn, Mg and impurities to cause a plated layer to adhere to the surface of the base metal. Next, the base metal to which the plated layer is caused to adhere is pulled up from the plating bath.

In this step, by suitably adjusting a speed at which the steel sheet is pulled up from the plating bath and the flow rate of a wiping gas, the thickness of the plated layer can be adjusted. As described above, it is preferable to perform an adjustment such that the entire thickness of the plated layer assumes 5 to 40 μm.

In the case where the above-mentioned Fe diffusion layer is desired to be formed in the plated layer, it is important to control, in the plating treatment step, the Si content in plating bath, an immersion time, and cooling speed after immersion. To be more specific, to promote the formation of the Fe diffusion layer, it is necessary to set the Si content in plating bath to a low value as described above.

The steel sheet is immersed into plating bath for 5 s or more and, further, after the steel sheet is pulled up from the plating bath, the steel sheet is thermally insulated or heated so as to suppress average cooling speed to 30° C./s or less. With such operations, diffusion of Fe can be sufficiently progressed. However, when the thickness of the Fe diffusion layer is excessively large, cracks may be formed at the time of winding up the steel sheet into a coil shape. Accordingly, it is preferable that the immersion time during which the steel sheet is immersed into the plating bath be set to 15 s or less, and average cooling speed after immersion be set to 5° C./s or more.

Accordingly, when it is desired that the Fe diffusion layer is formed in the plated layer, and the ratio of the thickness of the Fe diffusion layer to the entire thickness of the plated layer is adjusted to a value which falls within a range from 15 to 50%, it is preferable that the immersion time during which the steel sheet is immersed into the plating bath be set to 5 to 15 s, and average cooling speed after immersion be set to 5 to 30° C./s or less.

(E) Hot Stamping Condition

The surface treated steel sheet of the present invention can be subjected to hot stamping to obtain a formed body excellent in fatigue property, spot weldability, and corrosion resistance after coating. When hot stamping is performed under conditions described hereinafter, it is possible to obtain a formed body excellent in the above-mentioned properties with more certainty. A rust preventive oil film forming treatment and blanking may be performed when necessary before hot stamping is performed.

[Hot Stamping Step]

Normal hot stamping is performed such that a steel sheet is heated to a temperature within a hot stamping temperature range (hot working temperature range) and, then, the steel sheet is subjected to hot working and, further, the steel sheet is cooled. According to a normal hot stamping technique, it is preferable to increase a heating speed of a steel sheet as much as possible so as to shorten a production time. Further, when a steel sheet is heated to a temperature within a hot stamping temperature range, the plated layer is sufficiently alloyed. Accordingly, in the normal hot stamping technique, an importance is not placed on control of heating conditions of the steel sheet.

However, to obtain a formed body excellent in the above-mentioned properties with more certainty, it is preferable to perform alloying heat treatment, where a surface treated steel sheet is held for a fixed time within a predetermined temperature range, when the temperature of the surface treated steel sheet is increased to a hot stamping temperature. Then, after alloying heat treatment is performed, the surface treated steel sheet is heated to a hot stamping temperature (quenching heating temperature), and is subjected to hot working and cooling.

To be more specific, first, the surface treated steel sheet is charged into a heating furnace (gas furnace, electric furnace, infrared furnace or the like). The surface treated steel sheet is heated to a temperature range from 500 to 750° C. in the heating furnace, and alloying heat treatment is performed, where the plated steel material is held for 10 to 450 s within this temperature range. Performing alloying heat treatment causes Fe in the base metal to diffuse in the plated layer so that alloying process progresses. Such alloying process can suppress LME. An alloying heating temperature is not necessarily set to a fixed temperature, and may vary within a range from 500 to 750° C.

After the alloying heat treatment is finished, the surface treated steel sheet is heated to a temperature range from the $Ac_3$ point to 950° C. and, then, is subjected to hot working. At this point of operation, a time during which the temperature of the surface treated steel sheet falls within a temperature range (oxidation temperature range) from the $Ac_3$ point to 950° C. is limited to 60 s or less. When the temperature of the surface treated steel sheet falls within the oxidation temperature range, the oxide film of the outer layer of the plated layer grows. When the time during which the temperature of the surface treated steel sheet falls within the oxidation temperature range exceeds 60 s, there is a possibility that the oxide film excessively grows, thus decreasing weldability of the formed body. On the other hand, a speed at which an oxide film is formed is extremely high and hence, the lower limit value of the time during which the temperature of the surface treated steel sheet falls within the oxidation temperature range is more than Os. However, when the surface treated steel sheet is heated in a non-oxidizing atmosphere, such as 100% nitrogen atmosphere, an oxide film is not formed. Accordingly, heating is performed in an oxidizing atmosphere, such as an air atmosphere.

Provided that the time during which the temperature of the surface treated steel sheet falls within the oxidation temperature range is 60 s or less, conditions, such as a heating speed and a maximum heating temperature, are not particularly defined, and various conditions under which hot stamping can be performed may be selected.

Next, the surface treated steel sheet which is taken out from the heating furnace is subjected to press forming using press tooling. In this step, the steel sheet is quenched by the press tooling simultaneously with this press forming. A cooling medium (water, for example) circulates in the press tooling so that the press tooling promotes heat dissipation of the surface treated steel sheet and hence, quenching is performed. With the above-mentioned steps, the formed body can be produced.

The description has been made by exemplifying a method which heats a surface treated steel sheet using a heating furnace. However, the surface treated steel sheet may be heated by resistance heating. Also in this case, the steel sheet is heated for a predetermined time by resistance heating, and the steel sheet is subjected to press forming using press tooling.

[Rust Preventive Oil Film Forming Step]

The rust preventive oil film forming step is a step which is performed after the plating treatment step and before the hot stamping step, and where rust preventive oil is applied by coating to the surface of a surface treated steel sheet to form a rust preventive oil film. The rust preventive oil film forming step may be arbitrarily included in the production method. In the case where a long time is required before hot stamping is performed after a surface treated steel sheet is produced, there is a possibility that the surface of the surface treated steel sheet is oxidized. However, when a rust preventive oil film is formed on a surface treated steel sheet by the rust preventive oil film forming step, the surface of the surface treated steel sheet is not easily oxidized. Accordingly, performing the rust preventive oil film forming step can suppress the formation of scale on the formed body. Any known technique may be used as a method for forming a rust preventive oil film.

[Blanking Step]

This step is a step which is performed after the rust preventive oil film forming step and before the hot stamping step, and where shearing and/or blanking is performed on the surface treated steel sheet to form the steel sheet into a particular shape. The sheared surface of the steel sheet on which blanking is performed is easily oxidized. However, in the case where a rust preventive oil film is formed on the surface of the steel sheet in advance, rust preventive oil expands also to the above-mentioned sheared surface to some extent. With such expansion of the rust preventive oil, it is possible to suppress oxidization of the steel sheet on which blanking is performed.

One embodiment of the present invention has been described heretofore. However, the above-mentioned embodiment is for the sake of example of the present invention. Accordingly, the present invention is not limited to the above-mentioned embodiment, and design modifications can be made when necessary without departing from the gist of the present invention.

Hereinafter, the present invention is described more specifically with reference to examples. However, the present invention is not limited to these examples.

Example 1

First, a base metal was prepared. That is, a slab was produced by continuous casting process using molten steel having the chemical composition shown in Table 1. Next, the slab was subjected to hot rolling so as to produce a hot rolled steel sheet, and the hot rolled steel sheet was further subjected to pickling. Thereafter, the hot rolled steel sheet was subjected to cold rolling, thus producing a cold rolled steel sheet. This cold rolled steel sheet was used as a base metal (sheet thickness: 1.4 mm) of a surface treated steel sheet.

TABLE 1

| Chemical composition of base metal (mass %, balance consisting of Fe and impurities) | | | | | | | | | |
|---|---|---|---|---|---|---|---|---|---|
| C | Si | Mn | P | S | sol. Al | N | B | Ti | Cr |
| 0.2 | 0.2 | 1.3 | 0.01 | 0.005 | 0.02 | 0.002 | 0.002 | 0.02 | 0.2 |

Next, using the base metal produced as described above, plating treatment was performed in accordance with conditions shown in Table 2 so as to produce surface treated steel sheets of respective test examples.

TABLE 2

| Steel sheet | Plating treatment conditions | | | | | | |
|---|---|---|---|---|---|---|---|
| | Composition of plating bath (mass %) | | | | | Immersion time | Cooling speed |
| No. | Al | Zn | Si | Mg | Cr + Ca + Sr + Ti | (s) | (° C./s) |
| 1 | 55.0 | 44.5 | — | 0.5 | — | 5 | 10 |
| 2 | 55.0 | 42.9 | 1.6 | 0.5 | — | 5 | 10 |
| 3 | 55.0 | 44.0 | — | 1.0 | — | 5 | 10 |
| 4 | 55.0 | 42.4 | 1.6 | 1.0 | — | 5 | 10 |
| 5 | 55.0 | 42.4 | 1.6 | 1.0 | — | 5 | 10 |
| 6 | 55.0 | 43.0 | — | 2.0 | — | 5 | 10 |
| 7 | 60.0 | 39.0 | — | 1.0 | — | 5 | 10 |
| 8 | 50.0 | 49.0 | — | 1.0 | — | 5 | 10 |
| 9 | 55.0 | 42.4 | 1.6 | 1.0 | — | 5 | 15 |
| 10 | 55.0 | 42.4 | 1.6 | 1.0 | — | 10 | 8 |
| 11 | 55.0 | 42.4 | 1.6 | 1.0 | — | 10 | 15 |
| 12 | 60.0 | 39.0 | — | 1.0 | — | 5 | 20 |
| 13 | 54.5 | 42.4 | 1.6 | 1.0 | 0.5 | 5 | 10 |
| 14 | 54.0 | 42.4 | 1.6 | 1.0 | 1.0 | 5 | 10 |
| 15 | 53.0 | 41.9 | 1.6 | 1.0 | 2.5 | 5 | 10 |
| 16 | 45.0 | 39.0 | 15.0 | 1.0 | — | 5 | 10 |
| 17 | 55.0 | 42.4 | 1.6 | 1.0 | — | 5 | 30 |
| 18 | 55.0 | 42.4 | 1.6 | 1.0 | — | 5 | 50 |
| 19 | 55.0 | 42.4 | 1.6 | 1.0 | — | 1 | 10 |
| 20 | 20.0 | 80.0 | — | — | — | 5 | 10 |
| 21 | 80.0 | 20.0 | — | — | — | 5 | 10 |
| 22 | 0.1 | 99.9 | — | — | — | 5 | 10 |
| 23 | 90.0 | — | 10.0 | — | — | 5 | 10 |
| 24 | 55.0 | 43.4 | 1.6 | — | — | 5 | 30 |
| 25 | 55.0 | 45.0 | — | 0.05 | — | 5 | 30 |
| 26 | 55.0 | 42.0 | — | 3.0 | — | 5 | 30 |

The average composition of the plated layer of the obtained surface treated steel sheet was measured. In performing a measurement, first, the surface treated steel sheet which includes the plated layer was dissolved with 10% HCl aqueous solution. At this point of operation, to cause only the plated layer to be dissolved, inhibitor which suppresses dissolution of Fe in the base metal was added to hydrochloric acid. Then, respective elements contained in the dissolved solution were measured by ICP-OES.

Further, the surface treated steel sheet was cut out to have a cross section, and SEM observation was performed in order to measure the entire thickness of the plated layer and the thickness of the Fe diffusion layer. The results of these measurements are shown in Table 3.

TABLE 3

| Steel sheet | Plated layer | | | | | | | | | | | |
|---|---|---|---|---|---|---|---|---|---|---|---|---|
| | Average composition (mass %) | | | | | | | | | Entire thickness | Thickness of Fe diffusion | Ratio of Fe diffusion |
| No. | Al | Zn | Si | Mg | Fe | Cr + Ca + Sr + Ti | Zn + Al | Zn/Al | Zn/Al × Mg | (μm) | layer (μm) | layer (%) |
| 1 | 56.9 | 27.5 | — | 0.5 | 15.1 | — | 84.4 | 0.5 | 0.2 | 13 | 5 | 38 |
| 2 | 54.8 | 31.9 | 2.4 | 0.6 | 10.3 | — | 86.7 | 0.6 | 0.3 | 15 | 4 | 27 |
| 3 | 52.3 | 30.3 | — | 1.1 | 16.3 | — | 82.6 | 0.6 | 0.6 | 13 | 5 | 38 |
| 4 | 54.1 | 29.8 | 2.3 | 1.0 | 12.8 | — | 83.9 | 0.6 | 0.6 | 13 | 3 | 23 |
| 5 | 54.7 | 29.2 | 2.1 | 0.9 | 13.1 | — | 83.9 | 0.5 | 0.5 | 13 | 4 | 31 |
| 6 | 52.8 | 34.1 | — | 1.9 | 11.2 | — | 86.9 | 0.6 | 1.2 | 15 | 4 | 27 |
| 7 | 58.2 | 23.4 | — | 0.9 | 17.5 | — | 81.6 | 0.4 | 0.4 | 12 | 5 | 42 |
| 8 | 57.2 | 25.0 | — | 1.0 | 16.8 | — | 82.2 | 0.4 | 0.4 | 13 | 5 | 38 |
| 9 | 49.6 | 39.0 | 1.8 | 1.1 | 8.5 | — | 88.6 | 0.8 | 0.9 | 14 | 3 | 21 |
| 10 | 52.8 | 23.2 | 1.9 | 0.8 | 21.3 | — | 76.0 | 0.4 | 0.4 | 17 | 8 | 47 |
| 11 | 54.7 | 34.1 | 2.1 | 0.9 | 8.2 | — | 88.8 | 0.6 | 0.6 | 18 | 3 | 17 |
| 12 | 60.8 | 32.2 | — | 1.1 | 5.9 | — | 93.0 | 0.5 | 0.6 | 12 | 5 | 42 |
| 13 | 54.2 | 28.9 | 2.1 | 1.0 | 13.0 | 0.8 | 83.1 | 0.5 | 0.5 | 15 | 3 | 20 |
| 14 | 54.3 | 28.3 | 2.3 | 1.0 | 12.8 | 1.3 | 82.6 | 0.5 | 0.5 | 14 | 3 | 21 |
| 15 | 54.1 | 27.9 | 2.1 | 1.2 | 11.9 | 2.8 | 82.0 | 0.5 | 0.6 | 14 | 3 | 21 |
| 16 | 45.7 | 37.5 | 14.2 | 1.1 | 1.5 | — | 83.2 | 0.8 | 0.9 | 15 | 1 | 7 |
| 17 | 51.8 | 39.6 | 1.6 | 0.8 | 6.2 | — | 91.4 | 0.8 | 0.6 | 14 | 2 | 14 |
| 18 | 54.9 | 40.1 | 1.2 | 1.3 | 2.5 | — | 95.0 | 0.7 | 0.9 | 13 | 1 | 8 |
| 19 | 53.2 | 37.5 | 1.6 | 1.0 | 6.7 | — | 90.7 | 0.7 | 0.7 | 14 | 2 | 14 |
| 20 | 28.4 | 66.3 | — | — | 5.3 | — | 94.7 | 2.3 | — | 10 | 2 | 20 |
| 21 | 72.1 | 11.7 | — | — | 16.2 | — | 83.8 | 0.2 | — | 15 | 4 | 27 |
| 22 | 0.2 | 98.6 | — | — | 1.2 | — | 98.8 | 493 | — | 10 | 0 | 0 |
| 23 | 72.1 | — | 9.2 | — | 18.7 | — | 72.1 | — | — | 20 | 5 | 25 |
| 24 | 55.2 | 37.2 | 1.8 | — | 5.8 | — | 92.4 | 0.7 | — | 15 | 2 | 13 |
| 25 | 55.2 | 38.8 | — | 0.1 | 5.9 | — | 94.0 | 0.7 | 0.07 | 14 | 2 | 14 |
| 26 | 56.2 | 35.1 | — | 3.0 | 5.7 | — | 91.3 | 0.6 | 1.9 | 14 | 2 | 14 |

Thereafter, a hot V-shaped bending test, a spot weldability evaluation test, and a corrosion resistance after coating evaluation test were performed on the surface treated steel sheets of the respective test examples as described below.

[Hot V-Shaped Bending Test]

Alloying heat treatment where the surface treated steel sheet is held at 700° C. for 120 s was performed on the surface treated steel sheet of each test example. Thereafter, the surface treated steel sheet was heated at 900° C. for 30 s. Immediately after the heating, hot V-shaped bending was performed on the surface treated steel sheet using three kinds of hand press machine, thus forming a formed body. The shapes of press tooling were set such that an outer side portion in the bending radius direction to which V-bending is applied extends by 10%, 15%, and 20% respectively at the time when bending is finished.

Thereafter, with respect to the cross section in the thickness direction of the V-shaped bent region of the formed body, a reflected electron image was observed using an SEM and a reflected electron detector so as to observe the presence or absence of occurrence of LME. Then, the case where crack propagates to a base metal (a portion where concentration of Fe is 98% or more) is assumed as occurrence of LME. In the evaluation of LME resistance by the hot V-shaped bending test, a formed body which has no cracks with extension by 20% is evaluated as excellent (1), a formed body which has cracks with extension by 20%, but which has no cracks with extension by 15% is evaluated as good (2), a formed body which has cracks with extension by 15%, but which has no cracks with extension by 10% is evaluated as fair (3), and a formed body which has cracks with extension by 10% is evaluated as fail (4).

When it is difficult to determine an end position of cracks with the above-mentioned observation, energy dispersive X-ray spectroscopy (EDS) is performed on a region around the end position of cracks using an energy dispersive X-ray microanalyzer so as to determine whether or not cracks extend to the base metal. In such an operation, a region where the total content of Al and Zn exceeds 0.5% is identified as a plated layer, and a region of a steel material on the inner side of such a region is identified as a base metal.

[Spot Weldability Evaluation Test]

Alloying heat treatment where the surface treated steel sheet is held at 700° C. for 120 s was performed on the surface treated steel sheet of each test example. Thereafter, the surface treated steel sheet was heated at 900° C. for 30 s. Immediately after heating, the steel sheet was sandwiched by flat plate shaped press tooling provided with a water cooling jacket so as to produce a plate-shaped formed body. Quenching was performed such that even a portion where a cooling speed at the time of performing hot stamping is slow has a cooling speed of 50° C./s or more until the portion is cooled to an approximate point (410° C.) at which martensitic transformation starts.

Spot welding was performed on these formed bodies using a DC power source at an applied pressure of 350 kgf. Tests were performed at various welding currents. A value of welding current at which the nugget diameter of a welding portion exceeds 4.7 mm was set to the lower limit value. A value of welding current was suitably increased, and a value of welding current at which dust is generated during welding was set to the upper limit value. Values between the upper limit value and the lower limit value are set as the proper current range, and the difference between the upper limit value and the lower limit value was used as an index of spot weldability. In the evaluation of spot weldability, a test piece with this value of 1.5 A or more is evaluated as excellent (1). A test piece with this value of 1.0 A or more and less than 1.5 A is evaluated as good (2). A test piece with this value of 0.5 A or more and less than 1.0 A is evaluated as fair (3). A test piece with this value of less than 0.5 A is evaluated as fail (4).

[Corrosion Resistance after Coating Evaluation Test]

Alloying heat treatment where the surface treated steel sheet is held at 700° C. for 120 s was performed on the surface treated steel sheet of each test example. Thereafter, the surface treated steel sheet was heated at 900° C. for 30 s. Immediately after heating, the steel sheet was sandwiched by flat plate shaped press tooling provided with a water cooling jacket so as to produce a plate-shaped formed body. Further, quenching was performed such that even a portion where a cooling speed at the time of performing hot stamping is slow has a cooling speed of 50° C./s or more until the portion is cooled to an approximate point (410° C.) at which martensitic transformation starts.

Further, surface conditioning was performed on each formed body for 20 s at a room temperature using a surface conditioning agent (product name: PREPALENE X) made by Nihon Parkerizing Co., Ltd. Next, phosphate treatment was performed using a zinc phosphate treatment solution (product name: PALBOND 3020) made by Nihon Parkerizing Co., Ltd. To be more specific, the temperature of the treatment solution was set to 43° C., and the formed body was immersed into the treatment solution for 120 s. With such operations, a phosphate coating was formed on the surface of the steel material.

After the above-mentioned phosphate treatment was performed, cationic electrodeposition paint made by NIPPON-PAINT Co., Ltd. was applied to each formed body by electrodeposition coating by slope energization at a voltage of 160 V and, further, was subjected to baking coating for 20 minutes at a baking temperature of 170° C. Control of the film thickness of the paint after the electrodeposition coating was performed under conditions that electrodeposition coating on a surface treated steel sheet before hot stamping forming is performed has a thickness of 15 μm.

A cross-cut was made on the formed body on which electrodeposition coating was performed such that the cross-cut reaches the steel material which is a base metal, and a composite corrosion test (JASO M610 cycle) was performed. Corrosion resistance was evaluated based on the width of coating blister. After a composite corrosion test of 180 cycles is performed on a formed body, the formed body with a width of coating blister of 2.0 mm or less is evaluated as excellent (1), the formed body with a width of coating blister of more than 2.0 mm and 3.0 mm or less is evaluated as good (2), the formed body with a width of coating blister of more than 3.0 mm and 4.0 mm or less is evaluated as fair (3), and the formed body with a width of coating blister of more than 4.0 mm is evaluated as fail (4).

[Evaluation Result]

It is an objective of the present invention to provide a surface treated steel sheet which is preferably used as a starting material of a formed body excellent in all of fatigue property (LME resistance), spot weldability, and corrosion resistance after coating with a good balance. Accordingly, by comprehensively taking these evaluation results into account, a surface treated steel sheet which has an evaluation of excellent or good in either test, thus having a comprehensive evaluation of "A" and a surface treated steel sheet which does not have an evaluation of fail in either test, thus having a comprehensive evaluation of "B" are assumed as acceptable. A surface treated steel sheet which has an evaluation of fail in either test, thus having a comprehensive evaluation of "C" is assumed as defective. These results are shown in Table 4.

TABLE 4

| | | Evaluation result# | | | | |
|---|---|---|---|---|---|---|
| Test No. | Steel sheet No. | Fatigue property (LME resistance) | Spot weldability | Corrosion resistance after coating | Comprehensive evaluation | |
| 1 | 1 | 2 | 2 | 2 | A | Inventive |
| 2 | 2 | 2 | 2 | 2 | A | example |
| 3 | 3 | 2 | 2 | 2 | A | |
| 4 | 4 | 2 | 2 | 2 | A | |
| 5 | 5 | 2 | 2 | 2 | A | |
| 6 | 6 | 2 | 2 | 2 | A | |
| 7 | 7 | 2 | 2 | 2 | A | |
| 8 | 8 | 2 | 2 | 2 | A | |
| 9 | 9 | 2 | 2 | 2 | A | |
| 10 | 10 | 2 | 2 | 2 | B | |
| 11 | 11 | 2 | 2 | 2 | B | |
| 12 | 12 | 2 | 2 | 2 | B | |
| 13 | 13 | 2 | 2 | 2 | B | |
| 14 | 14 | 2 | 3 | 2 | B | |
| 15 | 15 | 2 | 3 | 2 | B | |
| 16 | 16 | 3 | 2 | 2 | B | |
| 17 | 17 | 3 | 2 | 2 | B | |
| 18 | 18 | 3 | 2 | 2 | B | |
| 19 | 19 | 3 | 2 | 2 | B | |
| 20 | 20 | 4 | 3 | 3 | C | Comparative |
| 21 | 21 | 2 | 2 | 4 | C | example |
| 22 | 22 | 4 | 3 | 3 | C | |
| 23 | 23 | 1 | 2 | 4 | C | |
| 24 | 24 | 2 | 1 | 4 | C | |
| 25 | 25 | 2 | 1 | 4 | C | |
| 26 | 26 | 4 | 4 | 1 | C | |

#1: excellent, 2: good, 3: fair, 4: fail

As can be clearly understood from Table 4, it is confirmed that when the surface treated steel sheet according to the present invention is used as a starting material, and hot stamping is performed under appropriate conditions, it is possible to obtain a formed body excellent in all of fatigue property (LME resistance), spot weldability, and corrosion resistance after coating with a good balance.

INDUSTRIAL APPLICABILITY

By performing hot stamping on the surface treated steel sheet according to the present invention, it is possible to obtain a formed body excellent in fatigue property, spot weldability, and corrosion resistance after coating. Accordingly, the formed body using the surface treated steel sheet according to the present invention as a starting material can be favorably used for a structural member or the like used in an automobile or the like.

The invention claimed is:

1. A steel sheet comprising: a base metal and a plated layer formed on a surface of the base metal, wherein an average composition of the plated layer contains, in mass %, Mg: 0.5 to 2.0%, Si: more than 0% and 5.0% or less, Fe: 8.2 to 25.0%, and following formulas (i) to (iii) are satisfied:

$$75.0 \leq Zn+Al \leq 98.5 \quad \text{(i)}$$

$$0.4 \leq Zn/Al \leq 1.5 \quad \text{(ii)}$$

$$(Zn/Al) \times Mg \leq 1.6 \quad \text{(iii)}$$

where, symbol of an element in the formulas refers to content (mass %) of each element contained in the plated layer, wherein the plated layer includes an Fe diffusion layer on a base metal side of the plated layer, a ratio of a thickness of the Fe diffusion layer to an entire thickness of the plated layer is between 15 and 31%, and the Fe diffusion layer contains an Fe—Al—Zn phase and a total area fraction of the Fe—Al—Zn phase is 90% or more, where the Fe—Al—Zn phase consists of one or more of $Fe(Al, Zn)_2$, $Fe_2(Al, Zn)_5$ and $Fe(Al, Zn)_3$, and wherein no cracks propagate to the base metal after a hot V-shaped bending test, where in the hot V-shaped bending test, the steel sheet is held at 700° C. for 120 s, thereafter the steel sheet is heated at 900° C. for 30 s, and immediately after the heating, hot V-shaped bending is performed on the steel sheet using hand press machine, wherein the shape of press tooling is set such that an outer side portion in the bending radius direction to which V-bending is applied extends by 15% at the time when bending is finished, a difference between (i) a value of welding current at which dust is generated during welding and (ii) a value of welding current at which the nugget diameter of a welding portion exceeds 4.7 mm is 1.0 A or more after a process of: an alloying heat treatment where the steel sheet is held at 700° C. for 120 s is performed; the steel sheet is heated at 900° C. for 30 s; immediately after heating, the steel sheet is sandwiched by flat plate shaped press tooling provided with a water cooling jacket so as to produce a plate-shaped formed body, thereby quenching is performed with a cooling speed to 410° C. of 50° C./s or more; and performing a spot welding test using a DC power source at an applied pressure of 350 kgf, and a width of a coating blister is 3.0 mm or less after a process of: an alloying heat treatment where the steel sheet is held at 700° C. for 120 s is performed; the steel sheet is heated at 900° C. for 30 s; immediately after heating, the steel sheet is sandwiched by flat plate shaped press tooling provided with a water cooling jacket so as to produce a plate-shaped formed body, thereby quenching is performed with a cooling speed to 410° C. of 50° C./s or more; a phosphate coating is formed on the surface of the plate-shaped formed body by the step of surface conditioning for 20 s at room temperature using a surface conditioning agent and immersing the plate-shaped formed body into a zinc phosphate treatment solution for 120 s at 43° C.; a cationic electrodeposition paint is applied to the plate-shaped formed body by electrodeposition coating by slope energization at a voltage of 160 V under conditions that electrodeposition coating on the steel sheet has a thickness of 15 μm and is subjected to baking coating for 20 minutes at a baking temperature of 170° C.; a cross-cut is made on the plate-shaped formed body on which electrodeposition coating is performed such that the cross-cut reaches a base metal of the plate-shaped formed body; and a composite corrosion test of 180 cycles is performed.

2. The steel sheet according to claim 1, wherein the average composition of the plated layer further satisfies a following formula (iv):

$$Mg+Ca+Ti+Sr+Cr \leq 2.0 \quad \text{(iv)}$$

where, symbol of an element in the formula refers to content (mass %) of each element contained in the plated layer.

3. The steel sheet according to claim 1, wherein a chemical composition of the base metal contains, in mass %, C: 0.05 to 0.4%, Si: 0.5% or less, and Mn: 0.5 to 2.5%.

4. The steel sheet according to claim 1, wherein the steel sheet is a cold-rolled steel sheet.

* * * * *